US006110092A

United States Patent [19]

Focke et al.

[11] Patent Number: 6,110,092

[45] **Date of Patent: *Aug. 29, 2000**

[54] PACK, IN PARTICULAR FOR CIGARETTES, AND METHOD AND APPARATUS FOR PRODUCING IT

[75] Inventors: Heinz Focke, Verden; Henry Buse, Visselhövede, both of Germany

[73] Assignee: Focke & Co. (GmbH & Co.), Verden, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/743,851

[22] Filed: Nov. 5, 1996

[30] Foreign Application Priority Data

Nov. 8, 1995 [DE] Germany ..... 19541541

[51] Int. Cl.[7] ..... B65D 75/38

[52] U.S. Cl. ..... 493/375; 493/910; 493/961; 493/114; 53/415

[58] Field of Search ..... 493/54, 55, 325, 493/375, 910, 911, 961, 114, 84; 53/415, 131.5, 135.3, 135.2; 156/DIG. 3, DIG. 4

[56] References Cited

U.S. PATENT DOCUMENTS

| | | | |
|---|---|---|---|
| 3,250,659 | 5/1966 | Jackson . | |
| 3,685,245 | 8/1972 | Frost | 53/415 |
| 3,734,804 | 5/1973 | Knecht et al. . | |
| 3,845,697 | 11/1974 | Niepmann | 493/910 X |
| 4,632,721 | 12/1986 | Hoffmann | 156/458 |
| 4,676,047 | 6/1987 | Mutoh . | |
| 5,035,935 | 7/1991 | Thomas et al. | 229/87.13 X |

FOREIGN PATENT DOCUMENTS

| | | |
|---|---|---|
| 0317202 | 5/1989 | European Pat. Off. . |
| 716022 | 6/1996 | European Pat. Off. . |
| 1542499 | 10/1968 | France . |
| 260605 | 6/1913 | Germany . |
| 1103227 | 3/1961 | Germany . |
| 1142310 | 1/1963 | Germany . |
| 2141829 | 3/1989 | Germany . |
| 4241462 | 6/1994 | Germany . |
| 5638075 | of 1954 | Japan . |
| 60-19487 | 9/1985 | Japan . |
| 2109810 | 4/1990 | Japan . |
| 676155 | 10/1994 | Japan . |
| 1448014 | 9/1976 | United Kingdom . |
| 2142319 | 1/1985 | United Kingdom . |
| 2211814 | 7/1989 | United Kingdom . |

*Primary Examiner*—Jacob K. Ackun
*Attorney, Agent, or Firm*—Abelman, Frayne & Schwab

[57] ABSTRACT

Pack with an outer wrapping consisting of transparent or clear packaging material and with a tear-open tape having a gripping end. For the coloured marking of the gripping end of the tear-open tape, there is applied to the latter a strip (15) which is detached from a material tape (17) and which is colour-contrasted relative to the tear-open tape and which thus marks the gripping end. In this case, the strip (15) is gripped by a holding segment (43) of a conveying roller (26) and is supplied to a film web (13) in order to bear on the latter. For the transfer of the strip (15) onto the film web (13), the holding segment (43) is moved in the radial direction, in order to overcome a clearance until it comes to bear on the film web (13).

8 Claims, 5 Drawing Sheets

PACK, IN PARTICULAR FOR CIGARETTES, AND METHOD AND APPARATUS FOR PRODUCING IT

DESCRIPTION

Figure 1:
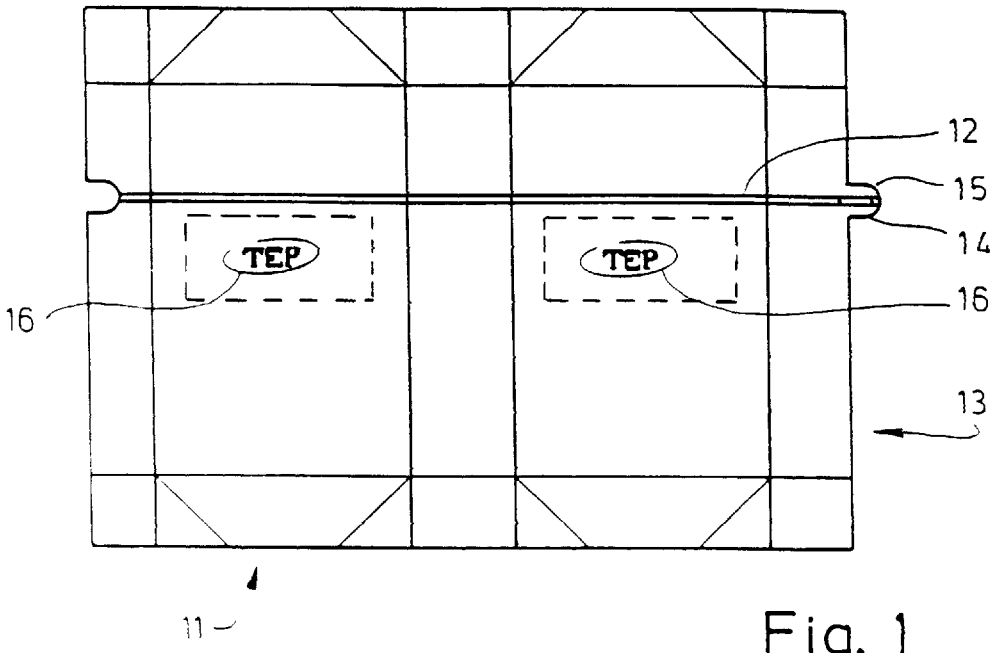

The invention relates to a pack with an outer wrapping consisting of transparent or clear packaging material, such as plastic film, in particular a cigarette pack. The invention relates, furthermore, to a method and apparatus for the production or preparation of the outer wrapping of this pack.

Cigarette packs, but also other packs, are conventionally constructed by surrounding them with an outer wrapping consisting of regenerated cellulose or plastic film, specifically of a clear type. Although the outer wrapping designed in this way is intended to allow an unrestricted view of the pack itself, there is, for various reasons, a demand for applying printing to the outer wrapping, that is to say to the clear or transparent film. This printing can be advertising elements, for example trademarks. Furthermore, however, it may also be desirable to apply coloured printing in the region of a gripping end of a tear-open tape or tear-open thread of the wrapping.

The (factory-made) coloured printing of plastic films is technically complicated. The entire film has to be conveyed through the printing unit. Moreover, it is difficult to apply the small-area prints in the correct position.

The invention is concerned with the application of, in particular, coloured markings to outer wrappings of packs consisting of transparent, in particular clear film material. The object on which the invention is based is to propose measures for a more efficient, effective application of small-area prints, markings or the like to the film web.

To achieve this object, the pack according to the invention is characterized by coloured or printed labels or small cutout pieces or strips of film which are applied to an inner face of the outer wrapping, the labels or small cutout pieces, approximately of the size of the printing, being connected to the inner face of the wrapping by adhesive bonding or heat-sealing.

In the invention, therefore, it is not the film of the outer wrapping itself which is printed. On the contrary, small portions or labels or small cutout pieces are detached from a material tape, on the whole coloured or printed with the desired particulars, marks or the like, and are fastened to the inner face of the wrapping by adhesive bonding or sealing. Due to their clear or transparent design, the coloured prints can thus be seen from outside. The material tape for producing the labels, small cutout pieces, strips, etc. is preferably a tape which is selfadhesive, that is to say provided with adhesive on one side. The detached labels, small cutout pieces, strips or the like have the size of the marking itself to be applied or are slightly larger.

A particular advantage of this solution according to the invention is that the self-adhesive labels, cutout pieces or the like can be applied in the region of the packaging machine, namely on a continuous film web. After the labels, small cutout pieces, etc. have been applied, namely stuck on, the blanks are detached from the film web and supplied to the article to be wrapped.

The concept according to the invention can be employed to particular advantage in applying marking tapes or pieces, namely strips, to the outer wrapping of a pack having a tear-open tape or tear-open thread, the latter conventionally likewise consisting of clear material. So that, when the pack is used, the gripping end of the clear tear-open thread or tear-open tape can be recognized reliably, the latter has a coloured design, the colour marking consisting of a dark or coloured strip which is formed in a way described and is applied to the inner face of the outer wrapping in the region of the gripping end.

In this case, the procedure is preferably such that the individual short strips are fastened directly to the inner face of the film web by adhesive bonding and thereafter the tear-open tape or tear-open thread is attached, so that the latter covers the strip on the inside. The strip is therefore positioned between the outer wrapping and the tear-open tape or tear-open thread.

The apparatus for producing and applying the labels or strips is designed in such a way that the labels or strips are detached from a tape intermittently, specifically by a severing knife rotating together with a conveying roller and by a stationary counterknife. A clean severing cut is thereby achieved.

In order, when the label or strip is being transferred onto the film web, to avoid damage to the latter by the co-rotating severing knife, there is formed between the circumference of the conveying roller and the film web a clearance which, in the region of transfer, is overcome by relative movement between the label or strip, on the one hand, and the film web, on the other hand.

Further details and features of the invention relate to the design of the pack, the production and application of the labels or strips and the apparatus for carrying out the method.

Figure 2:
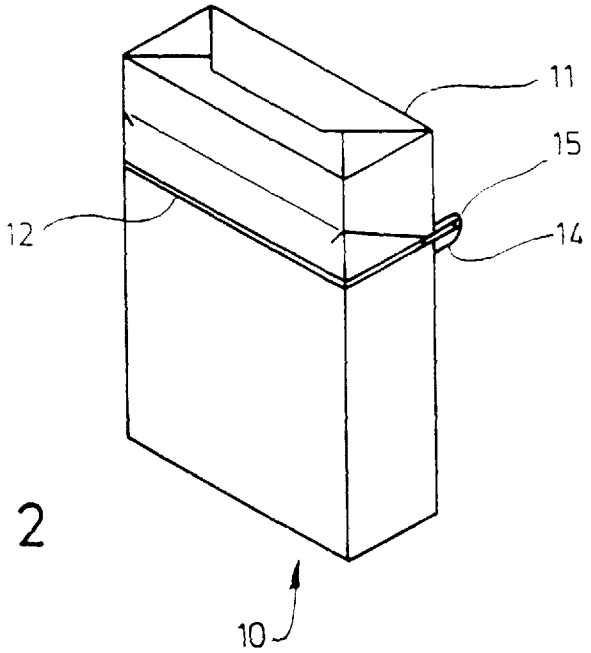
Figure 3:
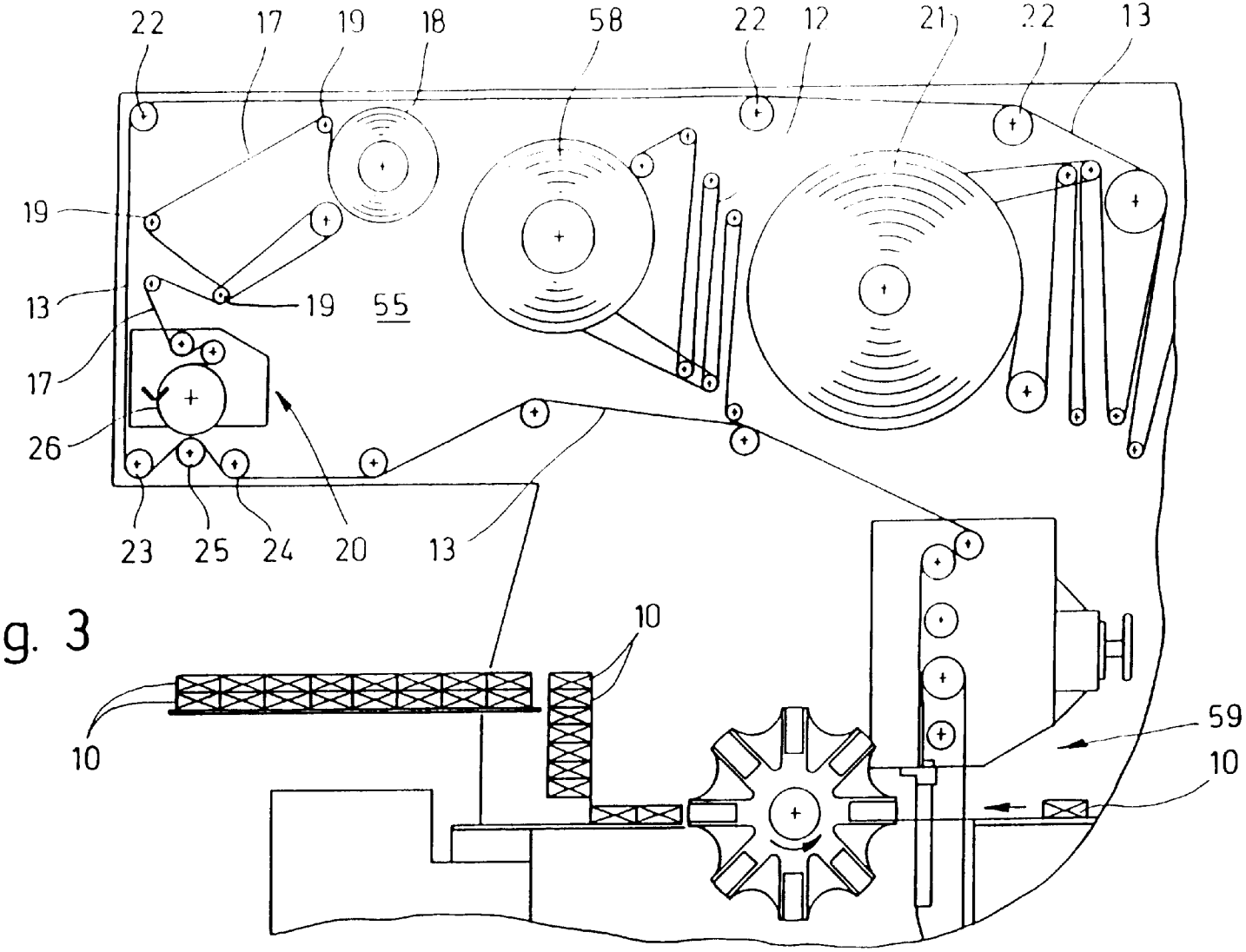
Figure 4:
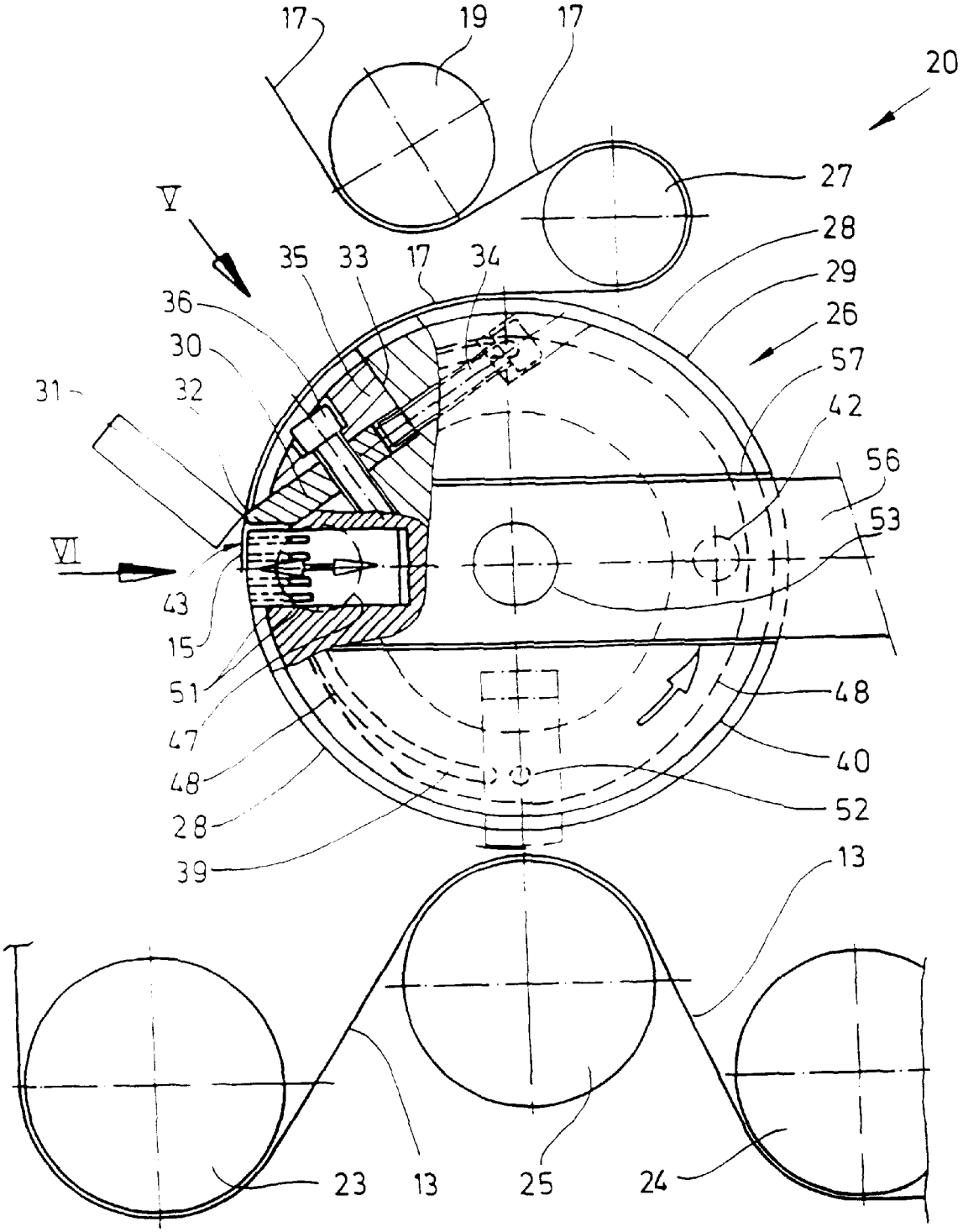
Figure 5:
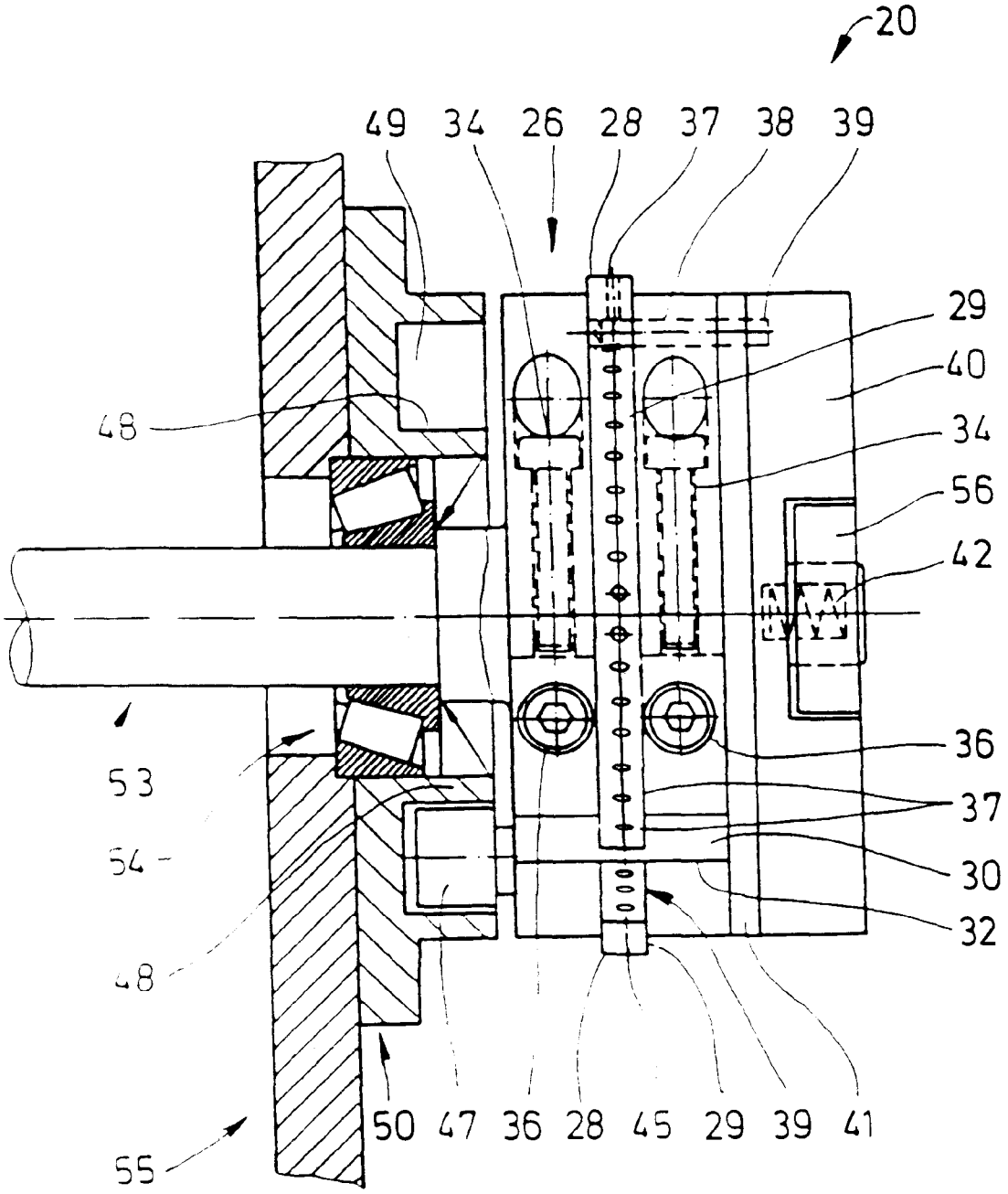
Figure 6:
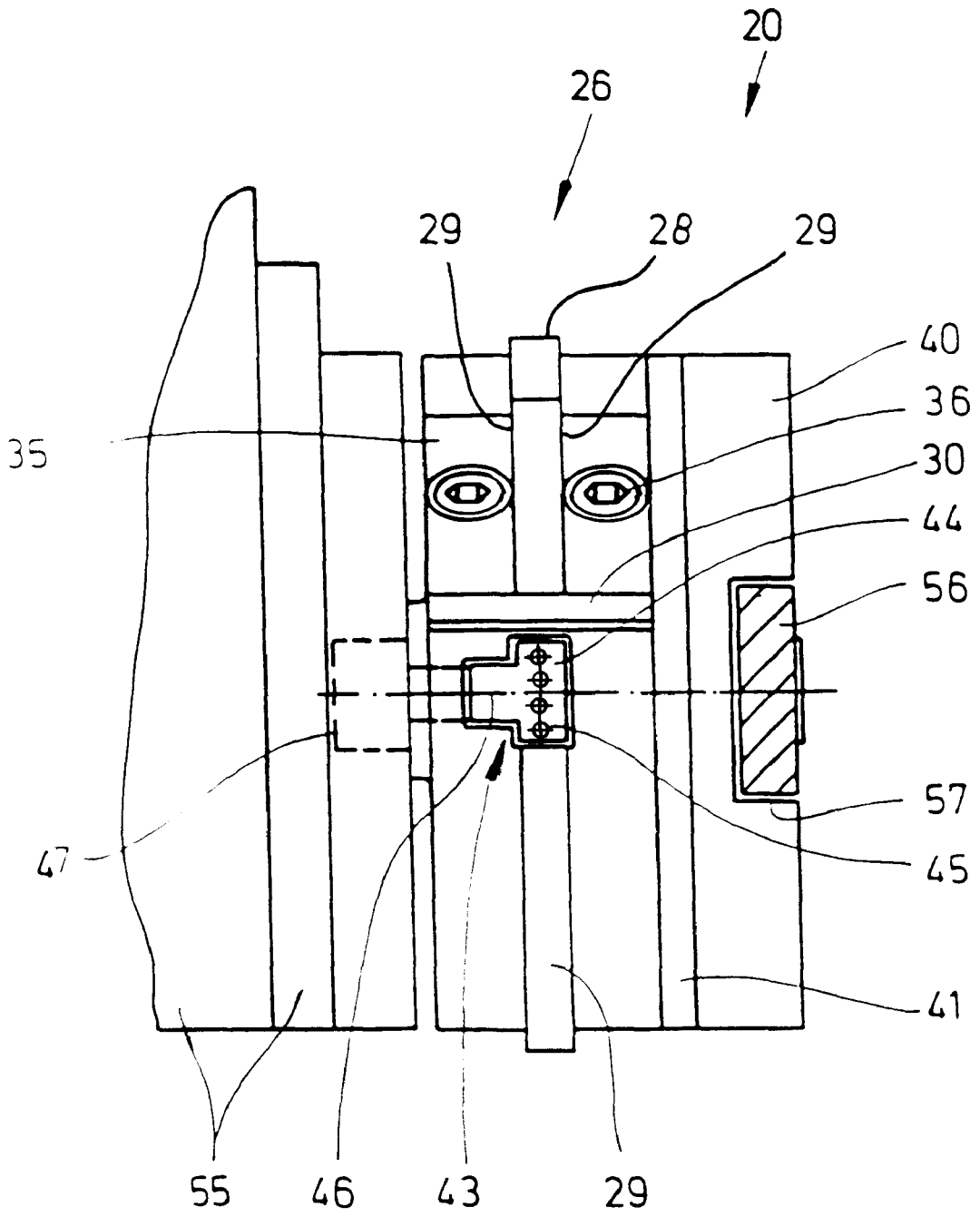

The drawings show an exemplary embodiment of a pack and, furthermore, details of an exemplary embodiment of the apparatus. In the drawings:

FIG. 1 shows a blank for an outer wrapping of a (cigarette) pack, the said blank being detached from a film web, FIG. 2 shows a cigarette pack of the hinge-lid type with an outer wrapping in a perspective representation, FIG. 3 shows a detail of a packaging machine with assemblies for the preparation and production of blanks for outer wrappings of (cigarette) packs in a diagrammatic side view, FIG. 4 shows a detail of the apparatus according to FIG. 3, namely an assembly for the production of strips and for laying them onto a film web, in a side view and on an enlarged scale, FIG. 5 shows a view of a strip transfer device according to the arrow V in FIG. 4, FIG. 6 shows a view of the same detail according to the arrow VI in FIG. 4.

Figure 7:
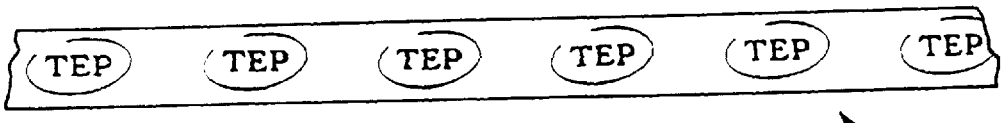

FIG. 7 shows the strip of tape.

The examples illustrated in the drawings relate to the manufacture of cuboid packs 10, specifically of cigarette packs of the hinge-lid type. Such a type of pack 10 is shown in FIG. 2. The pack consisting of thin cardboard is surrounded by an outer wrapping 11. This consists of a transparent or clear film, in particular plastic film.

FIG. 1 shows a spread-out blank for an outer wrapping 11 of this type. To use the pack 10, the outer wrapping 11 is provided with a tear-open tape 12. This extends in the longitudinal direction of the blank of the outer wrapping 11, the said longitudinal direction corresponding at the same time to the longitudinal extent of a film web 13 for producing the blanks. The tear-open tape 12 runs over the entire dimension of the blank, in such a way that, in an upper region of the pack 10, the outer wrapping 11 is provided all-round with a tear-open tape 12. When the pack 10 is used, an upper cap-shaped region of the outer wrapping 11 is detached as a result of the actuation of the tear-open tape 12.

To grasp the tear-open tape 12, the outer wrapping 11 is provided with a tongue in the region of a free gripping end 14 of the tear-open tape 12.

The gripping end of the tear-open tape 12 is not always easy to recognize. Particularly in the case of tear-open tapes 12 consisting of transparent or clear material, it is difficult to find the gripping end 14 which may possibly rest against a pack face. For this reason, the gripping end 14 is provided completely or partially with a coloured or dark marking. In the present case, this consists of a coloured or dark label or strip 15 which is produced separately and which is applied as an independent element to the outer wrapping 11 in the position shown and is connected to the latter. The strip 15, which here, is positioned approximately congruently with the tear-open tape 12 in the region of the gripping end 14, makes it easier to locate the gripping end 14.

Furthermore, in the example of FIG. 1, the outer wrapping 11 is provided with prints, specifically with pictorial and/or written markings, marks or the like. These prints, too, consist of small labels 16 which are made separately together with the print and which are applied to the outer wrapping 11, specifically by adhesive bonding or by heat-sealing.

The two small cutout pieces, namely the strip 15 and labels 16, are applied, in the region of a packaging machine or of a packaging assembly, as shown by way of example in FIG. 3, to the film web 13 in order to produce the blanks for the outer wrapping 11. In this case, strips 15 or labels 16 are detached from a continuous material tape 17 and are connected to the outer wrapping 11 or to the film web 13 before the blanks are detached. In the present exemplary embodiment, the material tape 17 consists of a self-adhesive web, so that the strips 15 or labels 16 are connected to the film web 13 in the correct position by adhesive bonding, specifically on that side of the outer wrapping 11 which is on the inside in the finished pack 10. For the production of strips 15, the material tape 17 can be coloured continuously. For the production of labels 16, the material tape 17 is provided with imprints in such a way that individual labels 16, each provided with an imprint, can be detached and connected to the film web 13. The printing of the material tape 17 can, at the same time, be applied to the adhesive or adhesive-free side of the material tape 17.

The material tape 17 which is shown in FIG. 7 can be drawn off from a tape reel 18. It is supplied via deflecting rolls 19 to a lay-on assembly 20. In the region of the latter, the strips 15 or labels 16 are detached from the material tape 17 and transferred onto the film web 13.

The film web 13 is drawn off from a film reel 21 and conveyed via deflecting rollers Z2 into the region of the lay-on assembly 20. Here, the film web 13 is guided via guide rollers 23, 24 and via a supporting roller 25 mounted between the guide rollers 23, 24. In the region of the said supporting roller, the strip 15 or label 16 is laid or pressed from above onto the film web 13.

The lay-on assembly 20 is provided with a conveying member for transporting a portion of the material tape 17 and the strip 15 or label 16 detached from the said material tape. The conveying member is a conveying roller 26. The material tape 17 is laid onto the circumference of the conveying roller 26 on top. Approximately in the region of a horizontal mid-plane, the strips 15 or labels 16 are detached from the material tape 17. In the lower region of the conveying roller 26 rotating about a horizontal axis, the strips 15 or labels 16 are transferred onto the film web 13.

The present exemplary embodiment relates to the application of a strip 15, so that this is referred to below as representing the labels, cutout pieces, etc. which come into consideration.

A predrawing roll 27 is positioned axis-parallel and adjacently to the conveying roller 26 and above the latter. This predrawing roll brings about the controlled drive or advance of the material tape 17, in such a way that the latter is advanced by the length of a strip 15 intermittently—in conformity with the machine cycle. The predrawing roller 27 is expediently designed here with a knurled outer surface, since, in the case of a material tape 17 having an adhesive face on one side, the said face bears on the circumference of the predrawing roll 27.

The conveying roller is driven intermittently, specifically in each case by one complete revolution. During this movement, the material tape 17 is further conveyed merely by a portion corresponding to the length of the strip 15. Moreover, during rotation, the material tape 17 bears on the circumference of the conveying roller 26 in a slipping or sliding manner.

The material tape 17 is laid onto the circumference of the conveying roller 26 in a middle region. The said conveying roller is provided with a radially outward projecting, annular bearing face 28 for the material tape 17 and label 16. The bearing face 28, which is expediently slightly wider than the material tape 17, is formed on an annular radially outward-projecting rib 29 of the conveying roller 26.

The material tape 17 bears on the circumference of the conveying roller 26 or the rib 29 approximately in the region of a quarter circle, specifically as far as a severing member. In the present case, the latter is arranged slightly above the horizontal mid-plane of the conveying roller 26. The severing assembly comprises a severing knife 30 and a stationary counterknife 31. The severing knife 30 is arranged on the rotating conveying roller 26 and projects with a cutting edge 32 slightly above the circumference of the conveying roller 26 or the bearing face 28. As a result, during each revolution of the conveying roller 26, a severing cut, by means of which a strip 15 is detached, is executed in the material tape 17.

The plate-shaped severing knife 30 is mounted exchangeably on the conveying roller 26. For this purpose, an approximately triangular indentation 33 is formed, in cross-section, in the conveying roller 26. The severing knife 30 is located in the exact position within this indentation 33. The severing knife 30 is fixed in this arrangement by means of holding screws 34 which can be actuated from the outer circumference of the conveying roller 26. The free region of the indentation 33 is covered by a filling piece 35 which, on the one hand, fixes the severing knife 30 in the cutting position and, on the other hand, completes the outer contour of the conveying roller 26. The filling piece 35 is likewise held by means of transversely directed connecting screws 36.

The holding screws 34 and connecting screws 36, of which there are two each, are arranged next to the rib 29, that is to say in a region of the conveying roller 26 with a smaller diameter. As a result, the cylindrical bearing face 28 for the material tape 17 is not interrupted.

The material tape 17 and the strip 15 are held on the circumference of the conveying roller 26 or on the bearing face 28 of the rib 29 by means of suction air. For this purpose, the rib 29 is provided all-round with a series of suction bores 37 located next to one another in the circumferential direction. These open out on the bearing face 28. The radially directed suction bores 37 are connected to transversely directly, that is to say axis-parallel junction bores 38 which run in the body of the conveying roller 26 and which are periodically connected to stationary suction segments 39. The suction segments 39, designed in the form of a part arc of a circle, are formed as open grooves in a fixed member of the apparatus and are connected to a vacuum source. In the present case, the suction segments 39 are arranged on one side of a fixed supporting disc 40, the said side facing the conveying roller 26. The conveying roller 26 bears on the supporting disc 40 and slides on the latter during rotation. In the present exemplary embodiment, a separate starting disc 41 is positioned between the conveying roller 26 and the supporting disc 40. The said starting disc consists of a wear-resistant material. The starting disc 41 is connected to the conveying roller 26, that is to say rotates together with the latter. The junction bores 38 run through the starting disc 41 as far as the suction segment 39 in the region of the supporting disc 40. The supporting disc 40 is pressed onto the rotating starting disc 41 resiliently, namely by means of a spring 42.

In the exemplary embodiment shown, the suction segment 39 extends approximately over half the circumference of the conveying roller 26, specifically from above, in the region of the supply of the material tape 17, approximately as far as the position of transfer of the strip 15 onto the film web 13. The suction bores 37 take effect in this circumferential region.

The film web 13 is deflected in the direction of the lower circumferential region of the conveying roller 26 in a transfer region for the strip 15 by means of a special guide, in the present case by means of the supporting roller 25 in conjunction with the guide rollers 23, 24 arranged on both sides.

So that, during the transfer of the strip 15 onto the film web 13, the latter is not destroyed by the severing knife 30 projecting beyond the plane of the bearing face 25, sufficient clearance is provided between the circumference of the conveying roller 26 or rib 29, on the one hand, and the film web 13 on the supporting roller 25, so that the cutting edge 32 of the severing knife 30 can reliably be moved past the film web 13 without any contact. For the transfer of the strip 15, this clearance must be overcome at least periodically, so that the transfer can take place.

For this purpose, in the present exemplary embodiment, the conveying roller 26 is equipped with a holding segment 43. The latter is part of the conveying roller 26 and can be moved relative to this, in the present case in the radial direction. In the normal position, the holding segment 43 is positioned flush with the conveying roller 26. A radially outer holding face 44 of the holding segment 43 extends flush with the bearing face 28 of the rib 29. In the present example, the holding segment 43 has predominantly the width of the rib 29, that is to say is part of the latter.

The holding segment 43 is positioned with the holding face 44 in such a way that a front end piece of the material tape 17 bears on the holding face 44 of the holding segment 43 as a result of a corresponding advancing movement of the predrawing roll 27. In this region too, a series of suction bores 45 located close to one another in the circumferential direction is provided, in order to hold the end of the material tape 17 or the strip 15 detached from the latter. For this purpose, the holding segment 43 is positioned in such a way that it is directly adjacent to the severing knife 30 in the circumferential direction of the rib 29. The detached strip 15 is therefore gripped over virtually the entire length by the holding segment 43.

To transfer the strip 15 onto the film web 13, the holding segment 43 is displaced outwards In the lower region of the conveying roller 26, that is to say beyond the circumferential face of the conveying roller 26. The movement of the holding segment 43 is controlled in such a way that the clearance relative to the film web 13 in the region of the supporting roller 25 is overcome and the strip 15 is laid or pressed onto the film web 13 by the holding segment 43. Thereafter, during the further rotation of the conveying roller 26, the holding segment 43 returns to the initial position.

In the present case, the controlled movement of the holding segment 43 in the radial direction is caused by mechanical members. For this purpose, an extension 46 is formed laterally on the holding segment 43. Mounted, in turn, on this extension 46 is a laterally directed tracer roll 47. This runs on a closed annular camtrack 48. The latter is part of a guide groove 49 in a fixed disc 50 arranged concentrically relative to the conveying roller 26.

The suction bores 45 of the holding segment 43 are connected to the suction segment 39 during rotation in the way described with regard to suction bores 37. For this purpose, junction bores 51 are connected to the suction bores 45 and, in the present case, are designed, at least in a region facing the suction segment 39, with a cross-section which is elongate or which resembles a long hole. This guarantees that at least a part region of the junction bores 51 remains connected to the common suction segment 39 even during the radial displacement of the holding segment 43.

The suction segment 39 terminates in the region of transfer of the strip 15 onto the film web 13, that is to say approximately in the vertical mid-plane of the conveying roller 26. Instead, a vent bore 52 is provided here, so that, in the radial end position, the strip 15 is no longer fixed to the holding segment 43 by suction air.

The conveying roller 26 driven continuously in rotation is seated on the end of a drive shaft 53. One end region of the drive shaft 53, the said end region being adjacent to the conveying roller 26, is supported in a housing wall 55 of the packaging machine by means of a tapered roller bearing 54.

The supporting disc 40 on the opposite side of the conveying roller 26 is mounted in a crossmember 56 extending axis-transversely. The latter is likewise connected to the supporting structure or machine housing. The crossmember extends in a diametral recess 57 of the supporting disc 40.

A similar procedure is adopted for applying (printed) labels 16 to the film web 13. Accordingly, portions of a material tape 17 having the labels 16 are detached. In this case, even during each rotation of the conveying roller 26, a plurality of labels 16 can be detached in succession and supplied to the film web 13 at shorter intervals. Alternatively, during rotation, the conveying roller can also be driven at relatively higher speed, so that, during the predrawing of the film web 13 by a blank is for the outer wrapping 11, a plurality of labels 16 can be transferred in succession.

The relative movement for transferring the strip 15 onto the film web 13 can also take place by means of another relative movement, for example by a brief movement of the film web 13 in the direction of the conveying roller 26. Alternatively, the severing knife 30 can also be mounted displaceably, so that, for transferring the strip 15 onto the film web 13, it is briefly retracted inwards out of the cutting position into the conveying roller 26. This solution requires no clearance between the conveying roller 26 and the film web 13.

The film web provided with a strip 15 and/or, if appropriate, with a plurality of labels 16 is transported further. In this case, a tear-open tape 12 drawn off from a thread reel 58 is laid continuously onto the film web 13, specifically in such a way that the strip 15 is covered by the tear-open tape 12. The film web 13 thus completed subsequently passes into the region of a blank assembly 59. Here, the individual blanks for the outer wrapping (FIG. 1) are produced and are folded round the packs 10 in a known way.

The conveying roller 26 may also be provided with a plurality, especially two, severing knives 30 distributed along the circumference, the working cycle of the conveying roller 26 being adapted correspondingly. In certain cases, the conveying roller 26 may also be driven intermittently, especially if two or more strips, labels or the like are processed in one working cycle.

We claim:

1. Method for the production of packs with an outer wrapping (11) of clear plastic film for the production of cigarette packs, including the following steps:

(a) applying single-layer labels (16), formed of small cutout pieces, or strips (15) to a continuous film web (13) made of clear plastic film;

(b) providing the single-layer labels (16) with printing which is visible through the clear plastic film web (13);

(c) applying the single-layer labels (16) to the side of the clear plastic film web (13) corresponding to the inner side of the outer pack wrapping (11);

(d) detaching the blanks for the outer pack wrapping (11) from the clear plastic film web (13); and (e) folding the blanks around the pack to form the outer wrapping (11).

2. The method for the production of packs in accordance with claim 1 wherein the single-layer labels (16) are applied to the web (13) by adhesive bonding.

3. The method for the production of packs in accordance with claim 1 wherein the single-layer labels (16) are applied to the web (13) by thermal sealing.

4. The method for the production of packs with an outer wrapping (11) comprising a clear plastic film web (13) with a tear-open tape (12) attached to the inner side of the outer wrapping (11), including the following steps:

(a) attaching a colored strip (15) formed of a short portion of a colored plastic film material tape (17), to the side of the film web (13) which corresponds to the inner side of the pack, with said colored strip forming a colored gripping end;

(b) applying the strip (15) at a position which corresponds to the position of a gripping end (14) formed by the film web (13) for the tear-open tape (12);

(c) applying a continuous tear-open film tape (12) to the film web (13) in such a way that the strip (15) is covered by the tear-open tape (12); and (d) detaching blanks for the outer wrapping (11) from the film web (13) in such a way that the strip (15) is located at an end of the tear-open tape (12) to mark the gripping end (14).

5. A method according to claim 1, characterized in that the single-layer labels (16) are detached in succession from a continuous material tape (17) in the form of an adhesive tape, transported to the film web (13) and laid onto the latter.

6. A method according to claim 4, characterized in that the single-layer labels (16) are detached in succession from a continuous material tape (17) in the form of an adhesive tape, transported to the film web (13) and laid onto the latter.

7. A method according to claim 5, characterized in that the single-layer labels (16) are laid onto the film web (13) in the region of an arch surface of the latter formed by a supporting roller (25) for the film web (13).

8. A method according to claim 6, characterized in that the single-layer labels (16) are laid onto the film web (13) in the region of an arch surface of the latter formed by a supporting roller (25) for the film web (13).

* * * * *